US010823481B2

(12) United States Patent
Gomes et al.

(10) Patent No.: US 10,823,481 B2
(45) Date of Patent: Nov. 3, 2020

(54) REFRIGERATOR COMPARTMENT WITH EVAPORATOR TO PROVIDE COLD AIR TO ICE MAKER

(71) Applicant: WHIRLPOOL CORPORATION, Benton Harbor, MI (US)

(72) Inventors: Alberto R. Gomes, St. Joseph, MI (US); Giulia Marinello, Park Ridge, IL (US); Vikas C. Mruthyunjaya, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 120 days.

(21) Appl. No.: 16/248,863

(22) Filed: Jan. 16, 2019

(65) Prior Publication Data

US 2020/0224957 A1 Jul. 16, 2020

(51) Int. Cl.
*F25D 17/08* (2006.01)
*F25C 1/04* (2018.01)

(52) U.S. Cl.
CPC ..... *F25D 17/08* (2013.01); *F25C 1/04* (2013.01)

(58) Field of Classification Search
CPC ..... F25D 17/08; F25D 17/00; F25D 17/06; F25D 17/065; F25D 17/067; F25D 17/042; F25D 17/045; F25D 23/04; F25C 1/04; F25C 1/24; F25C 2400/10
See application file for complete search history.

(56) References Cited

U.S. PATENT DOCUMENTS

| | | | | |
|---|---|---|---|---|
| 7,614,244 | B2 | 11/2009 | Venkatakrishnan et al. | |
| 7,707,847 | B2 | 5/2010 | Davis et al. | |
| 8,196,427 | B2 | 6/2012 | Bae et al. | |
| 9,010,145 | B2 | 4/2015 | Lim et al. | |
| 9,140,472 | B2 | 9/2015 | Shin et al. | |
| 2008/0148761 | A1 * | 6/2008 | Venkatakrishnan | F25D 17/065 62/340 |
| 2017/0241694 | A1 | 8/2017 | Ji et al. | |
| 2017/0248348 | A1 * | 8/2017 | Kim | F25B 49/02 |
| 2017/0307281 | A1 | 10/2017 | Morgan et al. | |
| 2018/0017306 | A1 | 1/2018 | Miller | |
| 2019/0003758 | A1 * | 1/2019 | Scalf | F25D 17/045 |

FOREIGN PATENT DOCUMENTS

| | | | | |
|---|---|---|---|---|
| CN | 205860622 U | | 1/2017 | |
| CN | 107990616 A | * | 5/2018 | F25D 11/02 |
| CN | 107990616 A | | 5/2018 | |
| EP | 3211354 A2 | | 8/2017 | |
| WO | 2018145354 A1 | | 8/2018 | |
| WO | 2018157810 A1 | | 9/2018 | |

* cited by examiner

*Primary Examiner* — Emmanuel E Duke
(74) *Attorney, Agent, or Firm* — Price Heneveld LLP

(57) ABSTRACT

A refrigerator includes a refrigerator compartment and a refrigerator evaporator disposed within an evaporator housing within the refrigerator compartment. A door is coupled to the refrigerator compartment and includes an ice maker. A duct assembly is disposed within the refrigerator compartment and includes an ice maker feed duct interconnecting the evaporator housing with the ice maker. The duct assembly further includes an ice maker return duct interconnecting the evaporator housing with the ice maker.

19 Claims, 8 Drawing Sheets

REFRIGERATOR COMPARTMENT WITH EVAPORATOR TO PROVIDE COLD AIR TO ICE MAKER

BACKGROUND

The present concept generally relates to a refrigeration device, and more particularly, to a refrigeration device in the form of a refrigerator having conduits directing cooled air from the refrigerator compartment to an ice maker disposed in a refrigerator door.

SUMMARY

In at least one aspect, a refrigerator includes a cabinet structure with a refrigerator compartment. An evaporator is positioned within the refrigerator compartment within an evaporator housing. A door is pivotally coupled to the cabinet structure for selectively providing access to the refrigerator compartment, wherein the door includes an ice maker operably coupled to the door for pivoting movement therewith. A duct assembly is disposed within the refrigerator compartment and includes an ice maker feed duct operably coupled to the evaporator housing at a first end and further coupled to the ice maker at a second end. The duct assembly further includes an ice maker return duct operably coupled to the evaporator housing at a first end and further coupled to the ice maker at a second end.

In at least another aspect, a refrigerator includes a liner defining a refrigerator compartment and having a top wall and a rear wall. A refrigerator evaporator is disposed within an evaporator housing within the refrigerator compartment. A wall covering assembly includes a top wall and a rear wall and is spaced-apart from the liner to form a cavity therebetween. An ice maker is disposed within the refrigerator compartment. A duct assembly is disposed within the cavity and includes an ice maker feed duct interconnecting the evaporator housing with the ice maker. The duct assembly further includes an ice maker return duct interconnecting the evaporator housing with the ice maker.

In at least another aspect, a refrigerator includes a refrigerator compartment having a liner, wherein the liner includes a top wall, a rear wall, first and second sidewalls and a bottom wall. A door is operably coupled to the refrigerator compartment between open and closed positions and includes an ice maker. A wall covering assembly includes a top wall disposed adjacent to and spaced-apart from the top wall of the liner and a rear wall disposed adjacent to and spaced-apart from the rear wall of the liner. The liner and the wall covering assembly cooperate to define a cavity therebetween. A refrigerator evaporator is disposed within the cavity. A duct assembly is disposed within the cavity and fluidically coupled to the refrigerator evaporator. The duct assembly includes an ice maker feed duct operably coupled to the ice maker when the door is in the closed position. The duct assembly further includes an ice maker return duct operably coupled to the ice maker when the door is in the closed position.

These and other features, advantages, and objects of the present device will be further understood and appreciated by those skilled in the art upon studying the following specification, claims, and appended drawings.

DETAILED DESCRIPTION OF EMBODIMENTS

Figure 1:
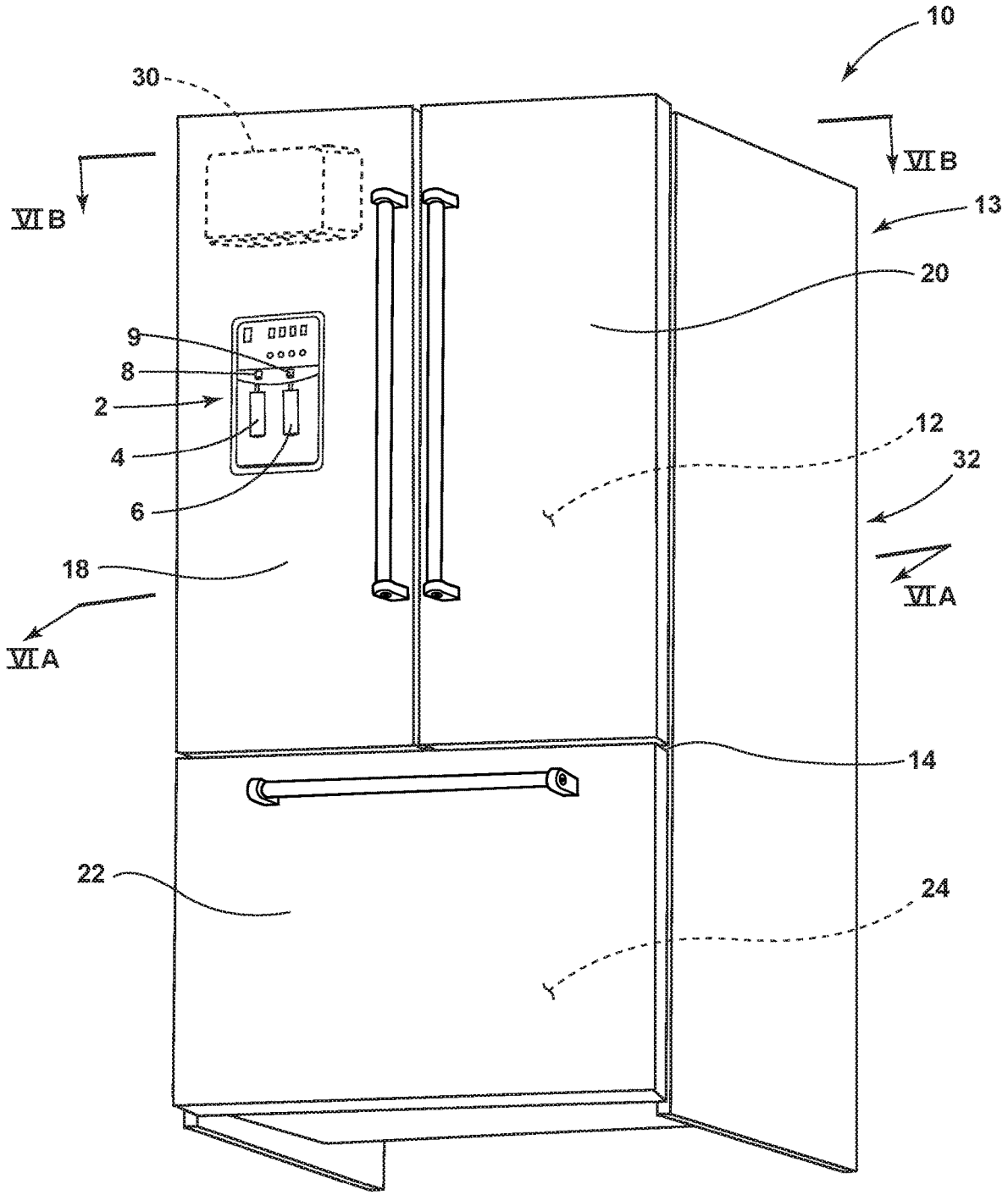
FIG. 1 is a bottom front perspective view of a refrigerator.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
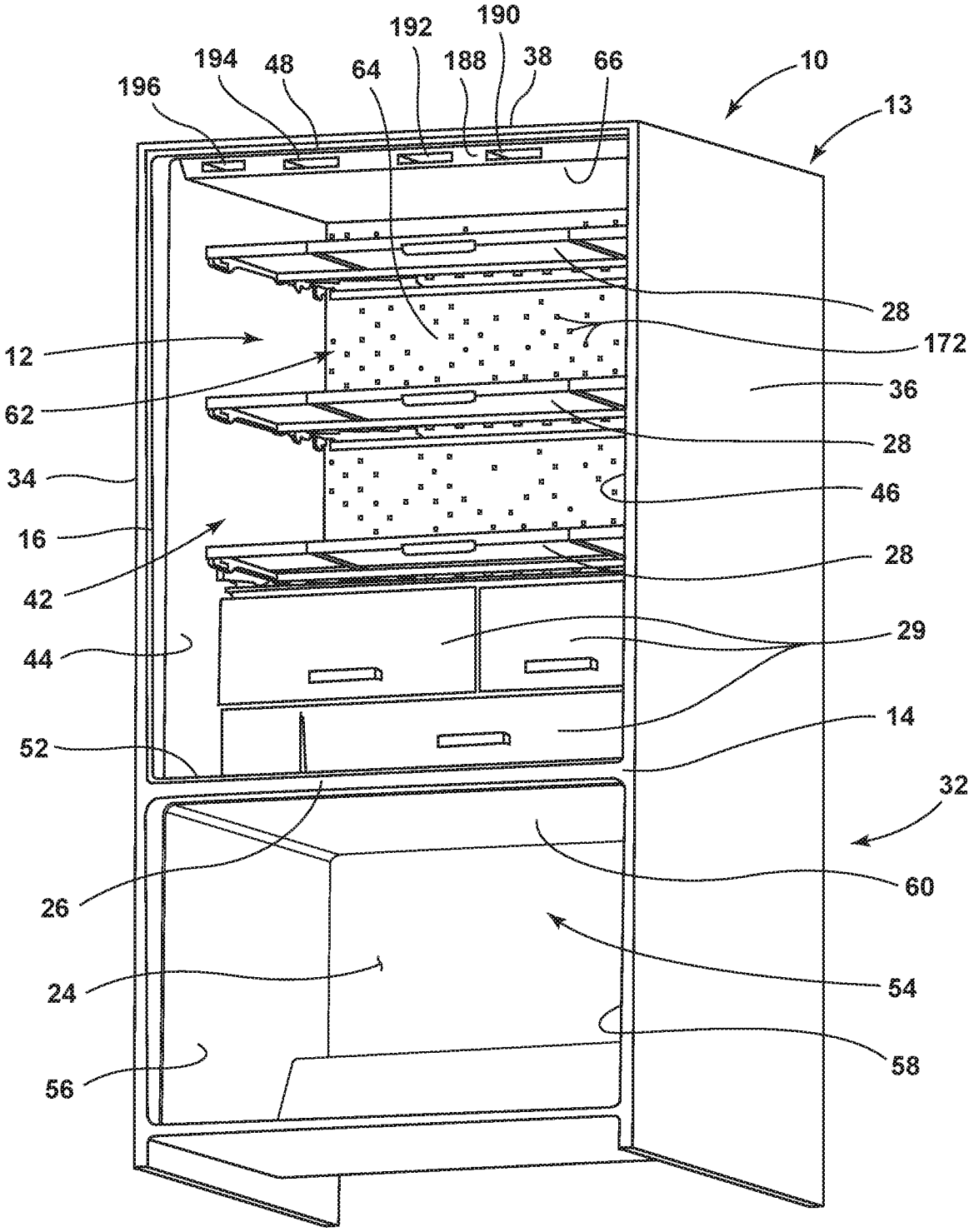
FIG. 2 is a front perspective view of the refrigerator of FIG. 1 with doors and drawers removed to reveal a refrigerator compartment and a freezer compartment.

Referring to the embodiment illustrated in FIG. 1, reference numeral 10 generally designates a refrigerator having a cabinet structure 13 with a front surface 14 that is generally disposed around a front opening 16 (FIG. 2) of a refrigerator compartment 12 (FIG. 2). The cabinet structure 13 may include a vacuum insulated cabinet structure, as further described below. The refrigerator compartment 12 is contemplated to be an insulated portion of the cabinet structure 13 for storing fresh food items. First and second doors 18, 20 are rotatably coupled to the cabinet structure 13 near the front surface 14 thereof for selectively providing access to the refrigerator compartment 12. In the embodiment shown in FIG. 1, a freezer drawer 22 is configured to selectively provide access to a freezer compartment 24 (FIG. 2) disposed below the refrigerator compartment 12. The refrigerator 10 shown in FIG. 1 is an exemplary embodiment of a refrigerator for use with the present concept, and is not meant to limit the scope of the present concept in any manner.

As further shown in FIG. 1, the first door 18 includes a dispensing station 2 which may include one or more paddles 4, 6 which are configured to initiate the dispensing of water and/or ice from outlets, such as outlets 8, 9. In the embodiment shown in FIG. 1, the dispensing station 2 is shown as being accessible from outside of the refrigerator 10 on an exterior portion of the first door 18, but may also be provided along any portion of the refrigerator 10, including an interior of the refrigerator compartment 12, for dispensing ice and/or water. The dispensing station 2 is contemplated to be coupled to an ice maker 30 which is shown in phantom in FIG. 1 as being disposed within the first door 18. As disposed within the first door 18, the ice maker 30 is operably coupled the first door 18 and moves pivotally with the first door 18 between open and closed positions.

Figure 6A:
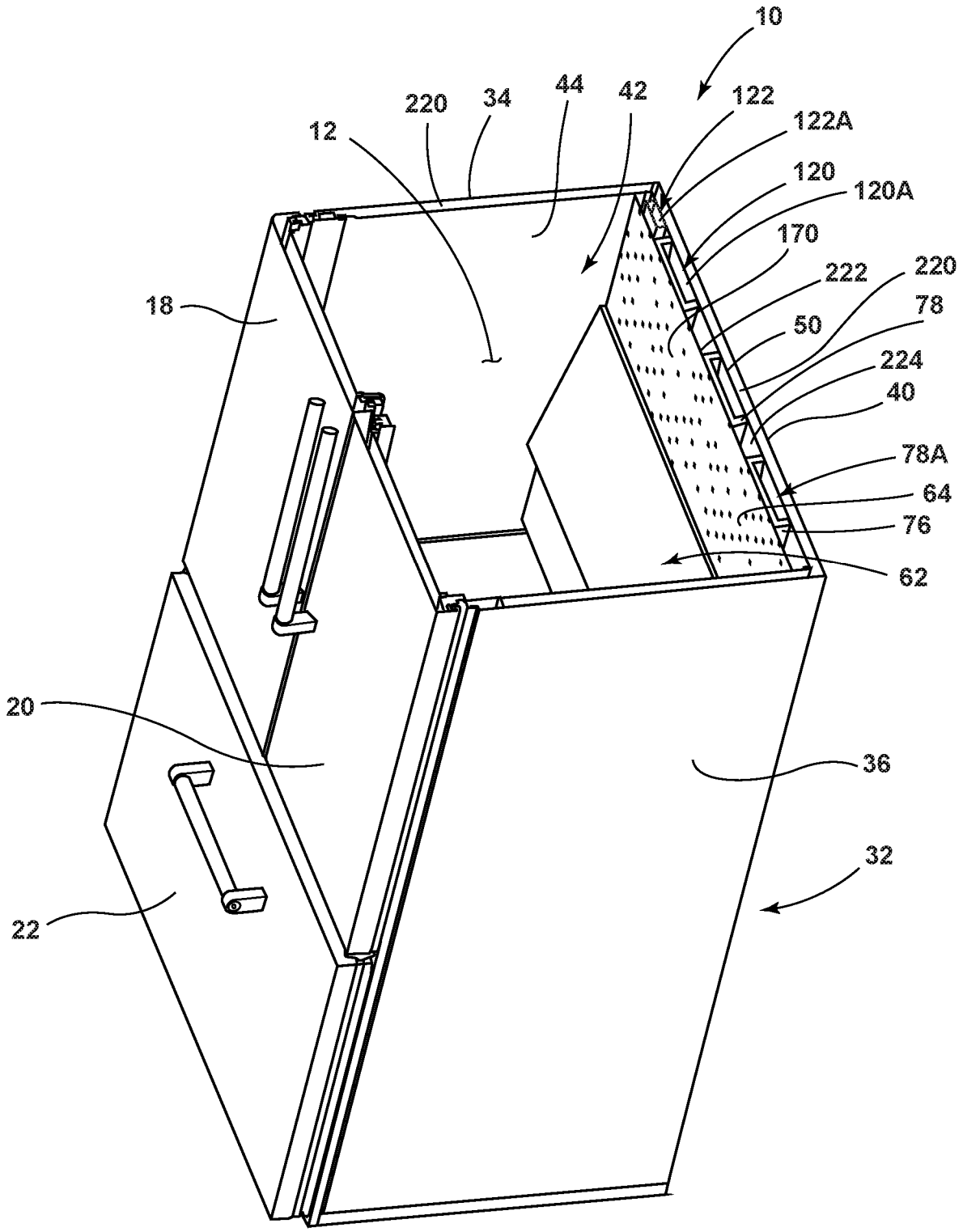
FIG. 6A is a cross sectional view of the refrigerator of FIG. 1 taken at line VIA.

Referring now to FIG. 2, the refrigerator 10 is shown with the first and second doors 18, 20 and freezer drawer 22 removed to reveal the refrigerator compartment 12 and freezer compartment 24 which are separated by a mullion 26. In the embodiment of FIG. 2, a number of shelves 28 are shown disposed in the refrigerator compartment 12 and are contemplated to be vertically adjustable therein. The refrigerator compartment 12 also includes a number of drawers 29 for storing various items, such as fresh fruits and vegetables, in specific temperature controlled environments. The refrigerator 10 includes an exterior wrapper 32 which includes first and second side walls 34, 36, top wall 38 and rear wall 40 (FIG. 6A). The exterior wrapper 32 is contemplated to be a metal component formed of a sheet metal material. As further shown in FIG. 2, the refrigerator 10 further includes a refrigerator liner 42 which includes first and second side walls 44, 46, top wall 48, rear wall 50 (FIG. 6A) and bottom wall 52. The freezer compartment 24 also includes a freezer liner 54 having first and second side walls 56, 58 and top wall 60. The refrigerator liner 42 and freezer liner 54 are also contemplated to be metal components made from a sheet metal material that is bent and welded to the specifications of the refrigerator 10. As encapsulated by the exterior wrapper 32, the refrigerator liner 42 and freezer liner 54 are spaced-apart from the exterior wrapper 32 to define an insulating space 220 (FIG. 6A) therebetween, which may include a vacuum insulated space. Thus, the exterior wrapper 32 and the refrigerator liner 42 and freezer liner 54 maybe interconnected with a trim breaker to define the cabinet structure 13 of the refrigerator 10.

As further shown in FIG. 2, a wall covering assembly 62 includes a rear wall 64 and a top wall 66 disposed over and adjacent to the rear wall 50 (FIG. 6A) and top wall 48 of the refrigerator liner 42. In this way, the wall covering assembly 62 defines rearmost and uppermost parameters of the refrigerator compartment 12, at rear wall 64 and top wall 66 thereof, that is visible to a user and available for storing fresh food items. The wall covering assembly 62 is configured to conceal a rearmost portion of the refrigerator compartment 12 where cooling components of the refrigerator 10 and air distribution systems for cooling the refrigerator compartment 12 and for specifically directing cooled air to the ice maker 30 are housed, as further described below. As shown in FIG. 2, the rear wall 64 of the wall covering assembly 62 is a ventilated wall having a plurality of ports 172 disposed therethrough. In use, the rear wall 64 of the wall covering assembly 62 is configured to provide cooled air to the refrigerator compartment 12, as further described below.

Figure 3:
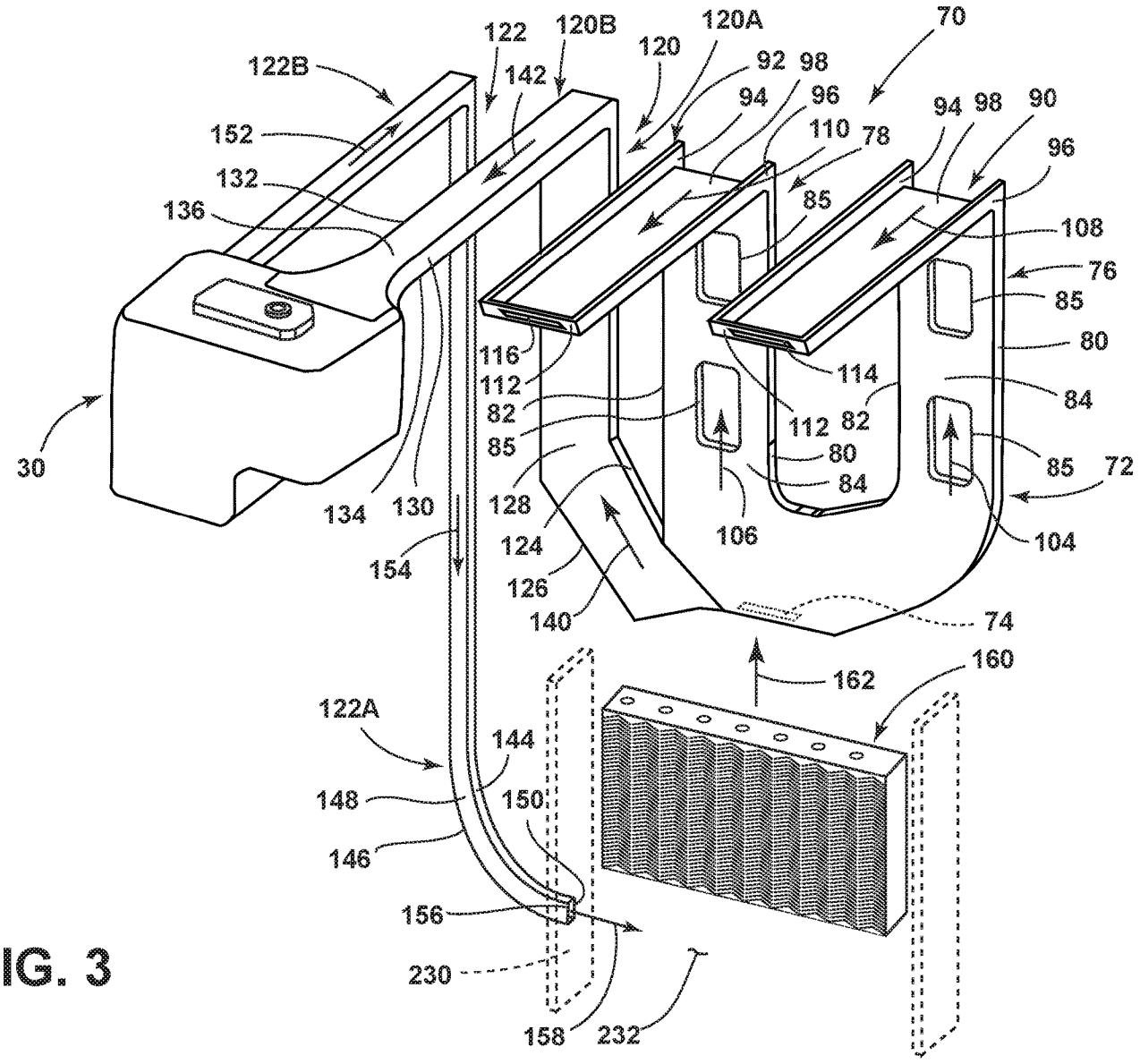
FIG. 3 is a top perspective view of a duct assembly as coupled to an ice maker.
Figure 5:
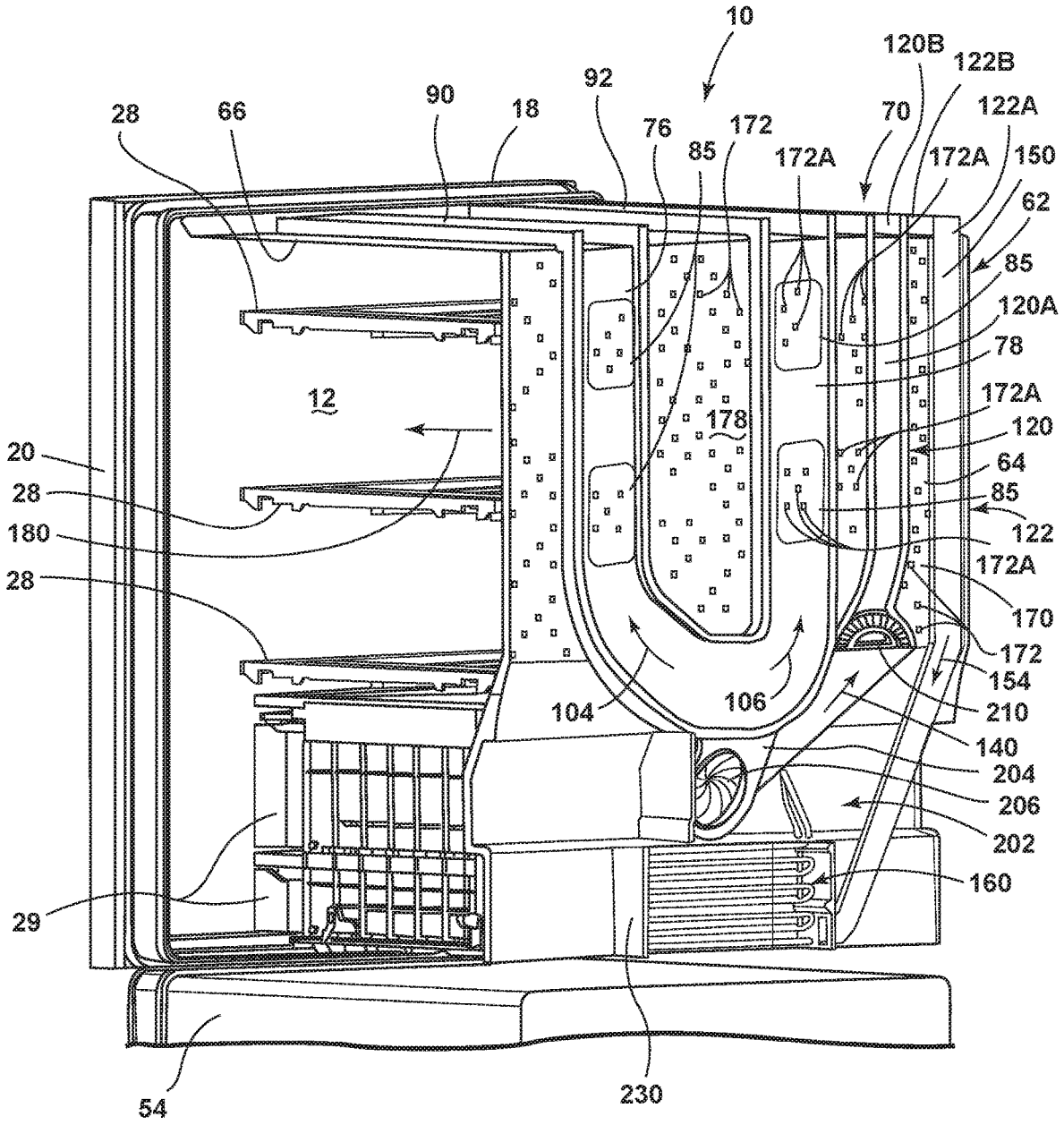
FIG. 5 is a rear perspective view of the duct assembly of FIG. 3 disposed on the wall covering assembly of FIG. 4.

Referring now to FIG. 3, a duct assembly 70 is shown. The duct assembly 70 is configured to be concealed behind the wall covering assembly 62, as shown in FIG. 2. The duct assembly 70 includes a lower portion 72 having a lower opening 74 disposed therethrough and shown in phantom in FIG. 3. In assembly, the lower opening 74 is configured to align with a housing for a radial fan for providing air to the duct assembly 70 as powered by the radial fan (FIG. 5). Extending upwardly from the lower portion 72, first and second upright ducts 76, 78 define an upright portion of the duct assembly 70. The first and second upright ducts 76, 78 each include first and second side walls 80, 82, which are spaced-apart and interconnected by front walls 84. Thus, the first and second side walls 80, 82 and front wall 84 of the first and second upright ducts 76, 78 define vertical channels which open outwardly towards the rear wall 50 of the refrigerator liner 42 in assembly.

As further shown in FIG. 3 at the uppermost portions of the first and second upright ducts 76, 78, first and second upper ducts 90, 92 outwardly extend in a substantially horizontal manner to define a lateral portion of the duct assembly 70. The upper ducts 90, 92 each include first and second side walls 94, 96 which are interconnected by bottom walls 98 to form upwardly opening horizontal channels. Thus, air flow is configured to flow upward in a direction as indicated by arrows 104, 106 in the vertical channels of the first and second upright ducts 76, 78, respectively, and is then directed outwardly in the directions as indicated by arrows 108, 110 along the horizontal channels of the first and second upper ducts 90, 92, respectively. As the air flows along the channels of the first and second upper ducts 90, 92 towards an end wall 112 thereof, the air is directed out through vents 114, 116. The horizontal channels of the first and second upper ducts 90, 92 are configured to direct air flow to the vents 114, 116 for cooling a front portion of the refrigerator compartment 12 and/or for cooling shelves and storage bins positioned on interior portions of the first and second doors 18, 20.

Figure 6B:
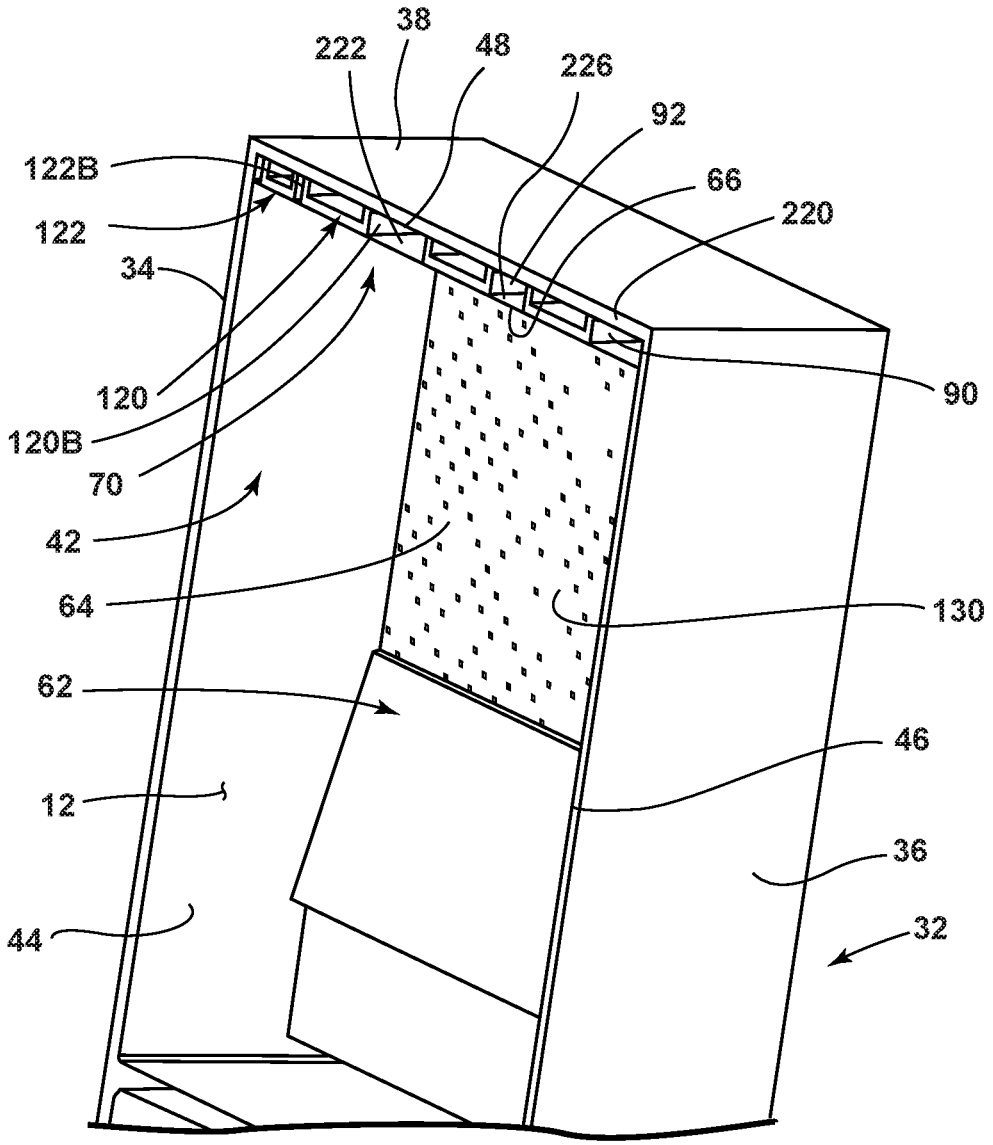
FIG. 6B is a cross sectional view of the refrigerator of FIG. 1 taken at line VIB.
Figure 7:
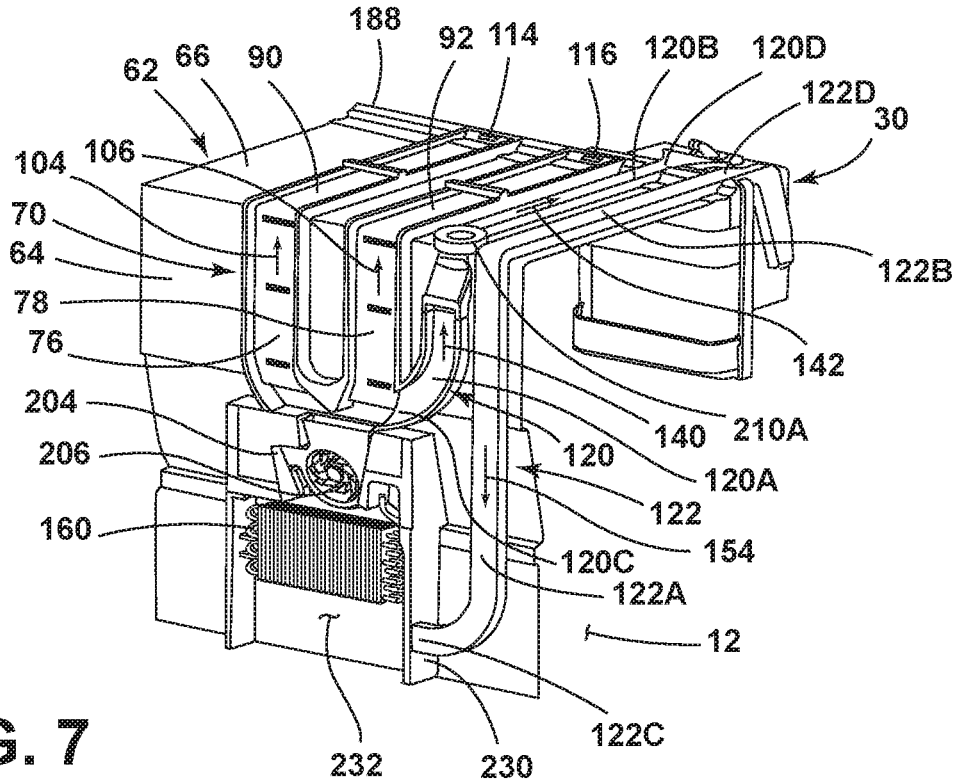
FIG. 7 is a rear perspective view of a duct assembly according to another embodiment disposed on the wall covering assembly of FIG. 4.
Figure 8:
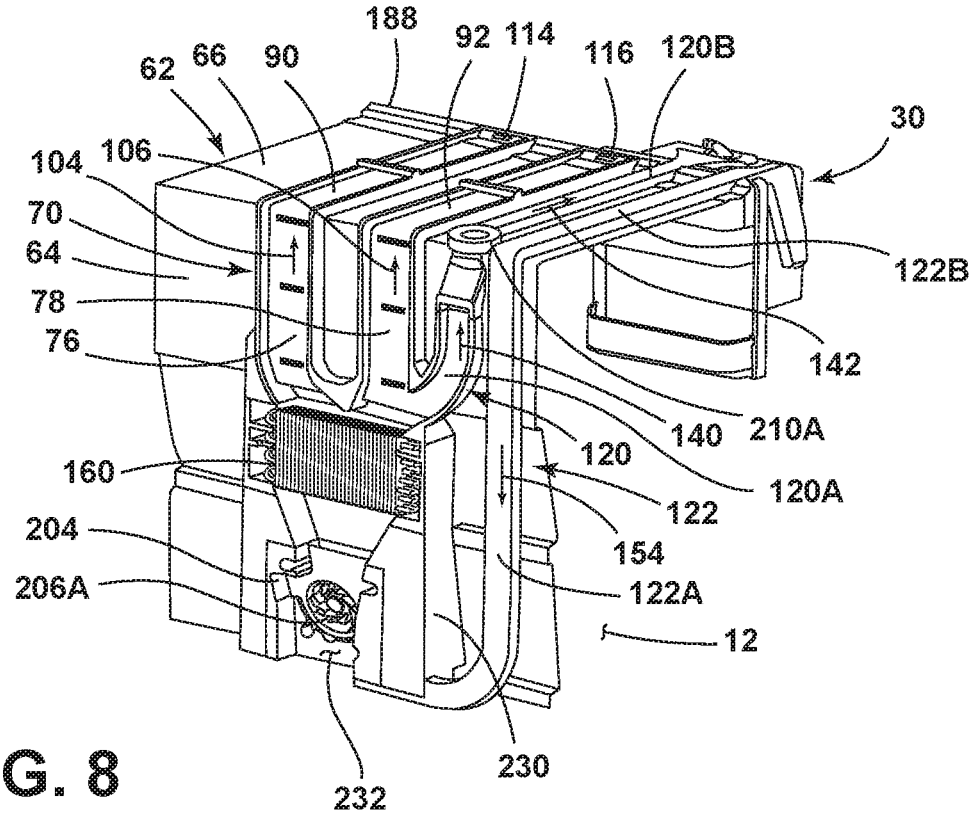
FIG. 8 is a rear perspective view of a duct assembly according to another embodiment disposed on the wall covering assembly of FIG. 4.

With further reference to FIG. 3, the first and second upright ducts 76, 78 of the duct assembly 70 are shown with the outwardly extending upper ducts 90, 92 extending in a substantially perpendicular manner relative to the first and second upright ducts 76, 78. The configuration of the duct assembly 70 is configured to compliment the configuration of the wall covering assembly 62, as best shown in FIGS. 5, 7 and 8. The configuration of the duct assembly 70 is also configured to compliment the configuration of the refrigerator liner 42, as best shown in FIGS. 6A, 6B. As further shown in FIG. 3, the first and second upright ducts 76, 78 include a plurality of access apertures 85 disposed through the front wall 84 thereof. The access apertures 85 are configured to allow for air to pass through the upright ducts 76, 78 as air is directed in the travel paths as indicated by arrows 104 and 106. In this way, the upwardly directed air can escape through the access apertures 85 to provide cooled air to the refrigerator compartment 12 through the ventilated rear wall 64 of the wall covering assembly 62. Thus, the upright ducts 76, 78 and the upper ducts 90, 92 interconnect the refrigerator compartment 12 with a refrigerator evaporator 160 to define one or more ducts of the duct assembly 70 configured to supply cooled air to the refrigerator compartment 12, as further described below.

With further reference to FIG. 3, the duct assembly 70 also includes an ice maker feed duct 120 and an ice maker return duct 122. The ice maker feed duct 120 includes a first portion 120A having first and second side walls 124, 126, which are spaced-apart and interconnected by a front wall 128. Thus, the first and second side walls 124, 126 and the front wall 128 of the first portion 120A of the ice maker feed duct 120 define a vertical channel which opens outwardly towards the rear wall 50 of the refrigerator liner 42 in assembly, as best shown in FIG. 5. The ice maker feed duct 120 further includes a second portion 120B outwardly extending in a substantially horizontal manner from the first portion 120A to partially define a lateral portion of the duct assembly 70. The second portion 120B of the ice maker feed duct 120 includes first and second side walls 130, 132 which are interconnected by bottom wall 134 and top wall 136 to define a horizontal channel. Thus, air flow is configured to flow upward in a direction as indicated by arrow 140 in the first portion 120A of the ice maker feed duct 120, and air is then directed outwardly in the direction as indicated by arrow 142 along the horizontal channel of the second portion 120B of the ice maker feed duct 120. Air flowing from the first portion 120A to the second portion 120B of the ice maker feed duct 120 is ultimately directed to the ice maker 30 contemplated to be disposed in the first door 18 (FIG. 1). In FIG. 3, the first door 18 has been removed to show where the ice maker 30 is disposed relative to the ice maker feed duct 120 when the door in which the ice maker 30 is disposed is in a closed position. Thus, the present concept provides for a supply duct for the ice maker 30 via ice maker feed duct 120, wherein the cooled air for the ice maker 30 comes from the refrigerator compartment 12 (i.e. the refrigerator evaporator 160), as opposed to a freezer compartment, such as freezer compartment 24.

With further reference to FIG. 3, the duct assembly 70 also includes the ice maker return duct 122. The ice maker return duct 122 includes a first portion 122A having first and second side walls 144, 146, which are spaced-apart and interconnected by a front wall 148 and a rear wall 150 (FIG. 5). Thus, the first and second side walls 144, 146, the front wall 148 and the rear wall 150 of the first portion 122A of the ice maker return duct 122 define a vertical channel. The ice maker return duct 122 further includes a second portion 122B outwardly extending in a substantially horizontal manner from the first portion 122A to partially define a lateral portion of the duct assembly 70. In use, air is configured to flow rearwardly in a direction as indicated by arrow 152 in the second portion 122B of the ice maker return duct 122, and air is then directed downwardly in the direction as indicated by arrow 154 along the vertical channel of the first portion 122A of the ice maker return duct 122. Air flowing from the second portion 122B to the first portion 122A of the ice maker return duct 122 is ultimately directed to a lower portion 232 of an evaporator housing 230 (FIG. 7). In FIG. 3, air exits the ice maker return duct 122 at outlet 156 in the direction as indicated by arrow 158 to enter the lower portion 232 of the evaporator housing 230. In FIG. 3, a refrigerator evaporator 160 is shown positioned above the location where the ice maker return duct 122 directs air flow. The refrigerator evaporator 160 provides cooled air that is drawn into the duct assembly 70 in the direction indicated by arrow 162 in a manner as further described below. As used herein, the term "refrigerator evaporator" refers to an evaporator positioned within the refrigerator compartment 12. Both the ice maker feed duct 120 and the ice maker return duct 122 are contemplated to be insulated ducts, as they are configured to carry much colder air as compared to the refrigerator compartment ducts 76, 78 and 90, 92. The ice maker feed duct 120 and the ice maker return duct 122 are contemplated to be insulated by a gas impervious barrier having an insulating material, such that the super cooled air carried in the ice maker feed duct 120 and the ice maker return duct 122 is not diffused to other components of the refrigerator 10 along the travel path between the evaporator housing 230 and the ice maker 30. The refrigerator evaporator 160 is contemplated to have multiple temperature settings for various cooling cycles, such that a first temperature level is provided to the refrigerator compartment ducts 76, 78 and 90, 92 during a refrigerator compartment cooling cycle, and a second temperature level, that is lower than the first temperature level, is provided to the ice maker feed duct 120 during an ice making cycle. Further, it is contemplated that cooled air returning from the ice maker 30 via the ice maker return duct 122 will have a controlled flow so as not to directly intermix with cooled air intended for the refrigerator compartment 12. However, it is further contemplated that the cooled air returning from the ice maker 30 via the ice maker return duct 122 can be used to cool the refrigerator compartment 12 in a hybrid refrigerator compartment cooling cycle to save energy.

Figure 4:
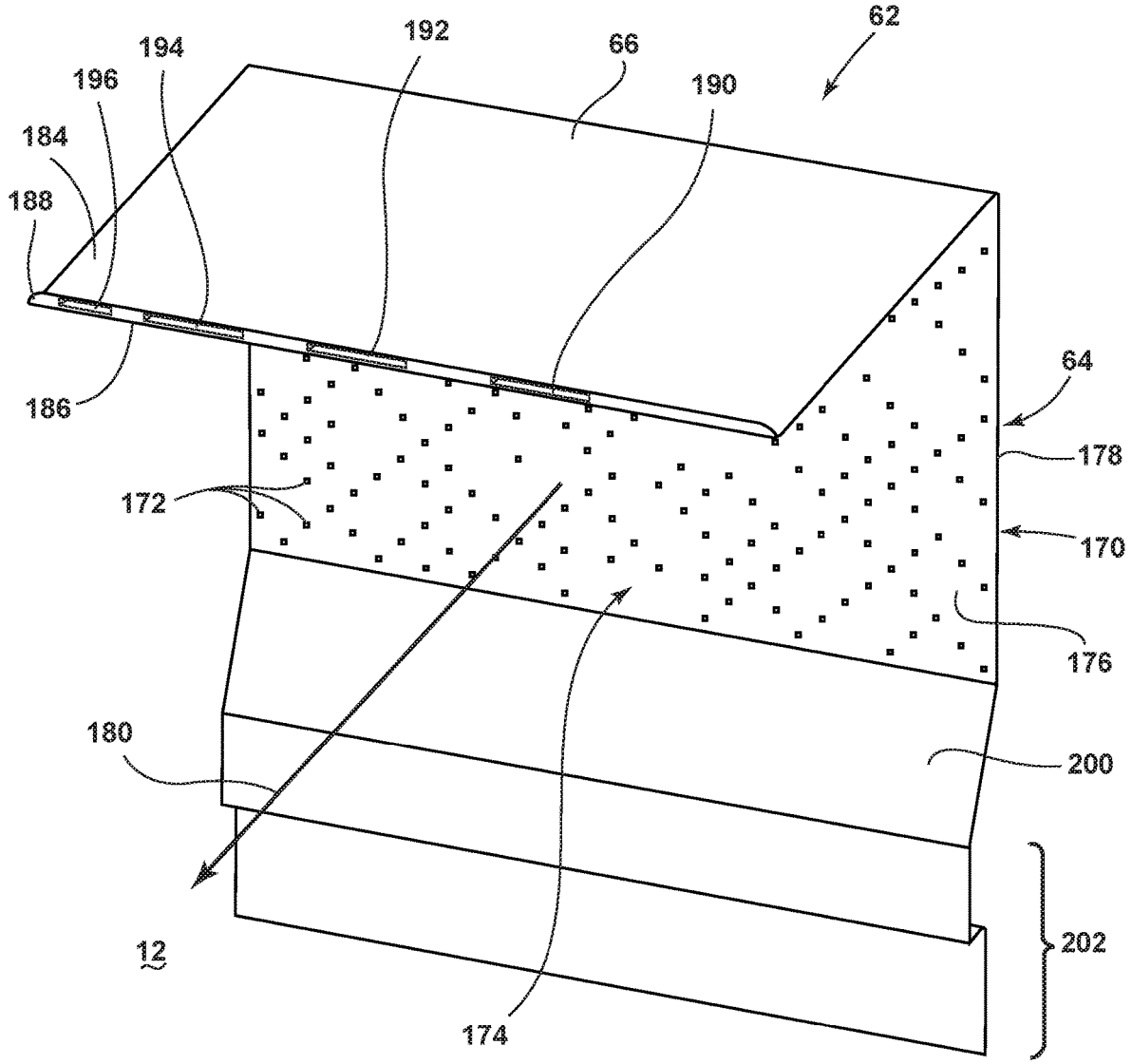
FIG. 4 is a top perspective view of a wall covering assembly.

Referring now to FIG. 4, the wall covering assembly 62 is shown having the rear wall 64 and the top wall 66, wherein the rear wall 64 is substantially vertical with top wall 66 extending outwardly therefrom in a substantially perpendicular or horizontal manner. As shown in FIG. 4, the rear wall 64 includes a ventilated portion 170 which is a substantially planar portion having a plurality of ports 172 disposed therethrough. Specifically, the ports 172 define venting apertures dispersed across the ventilated portion 170, such that the entire ventilated portion 170 includes ports 172 disposed therethrough. The ventilated portion 170 includes an outer surface 176 and an inner surface 178. It is the inner surface 178 of the ventilated portion 170 that is contemplated to contact the front wall 84 of the upright ducts 76, 78 of the duct assembly 70 shown in FIG. 3. Further, it is contemplated that a number of the ports 172A (FIG. 5) will be aligned with the access apertures 85 of the upright ducts 76, 78, such that the air flow will not only be directed in an upward direction in the upright ducts 76, 78, as indicated by arrows 104, 106 in FIG. 3, but will also be directed outwardly towards the refrigerator compartment 12 in a direction as indicated by arrow 180 in FIG. 4 from the access apertures 85 of the upright ducts 76, 78.

As further shown in FIG. 4, the top wall 66 of the wall covering assembly 62 includes an inner surface 184 and an outer surface 186. A front lip portion 188 is disposed at a front edge of the top wall 66, as shown in FIG. 4. The front lip portion 188 of the top wall 66 is an angled portion which further includes venting slots 190, 192 which are configured to align with the vents 114, 116 of the upper ducts 90, 92 shown in FIG. 3. In this way, air channeled through the refrigerator compartment ducts 76, 78 and 90, 92 of the duct assembly 70 is directed through the vents 114, 116, for distribution into the refrigerator compartment 12 through venting slots 190, 192 of the wall covering assembly 62. Thus, the ports 172 open outwardly into the refrigerator compartment 12 for cooling the refrigerator compartment 12 with an air flow directed in a perpendicular manner emanating from the ventilated portion 170 of the wall covering assembly 62 as indicated by arrow 180. Further, the air directed through venting slots 190, 192 can be used as an air curtain, or to cool shelves and bins disposed on the inner surfaces of the first and second doors 18, 20 (FIG. 1). The front lip portion 188 of the top wall 66 further includes venting slots 194, 196 which are configured to align with the second portions 120B, 122B of the ice maker feed duct 120 and the ice maker return duct 122, respectively, shown in FIG. 3. In this way, air channeled through the ice maker feed duct 120 is directed through the venting slot 194 of the wall covering assembly 62 and into the ice maker 30. Air is returned from the ice maker 30 through venting slot 196 of the wall covering assembly 62 to the ice maker return duct 122.

As further shown in FIG. 4, the wall covering assembly 62 also includes an inclined portion 200 which generally defines a housing area 202 which is used to house and conceal components used to cool air for cooling the refrigerator compartment 12. Such components may include fans for directing the cooled air, evaporators, condensers and other components (i.e., electrical components) of the refrigerator 10. As better shown in FIGS. 5-8, the wall covering assembly 62 provides a false wall to the refrigerator compartment 12 that is spaced-apart from the refrigerator liner 42, such that the duct assembly 70, and other components of the refrigerator 10, can be concealed behind the false wall of wall covering assembly 62.

Referring now to FIG. 5, the refrigerator 10 is shown with the exterior wrapper 32 and liner 42 removed to reveal the duct assembly 70 disposed along the wall covering assembly 62. Specifically, the upright ducts 76, 78 are disposed along the rear wall 64 of the wall covering assembly 62. Similarly, the first portions 120A, 122A of the ice maker feed duct 120 and the ice maker return duct 122, respectively, are disposed along the rear wall 64 of the wall covering assembly 62. As further shown in FIG. 5, the upper ducts 90, 92 are disposed along the top wall 66 of the wall covering assembly 62. Similarly, the second portions 1206, 122B of the ice maker feed duct 120 and the ice maker return duct 122, respectively, are disposed along the top wall 66 of the wall covering assembly 62. In this way, the configuration of the duct assembly 70 follows the configuration of the wall covering assembly 62.

As further shown in FIG. 5, a first fan 206 is shown positioned within a fan housing 204 for providing cooled air to the duct assembly 70. In the embodiment shown in FIG. 5, the first fan 206 is a radial fan disposed above the refrigerator evaporator 160 within an evaporator housing 230. The refrigerator evaporator 160 is configured to provide cooled air to the evaporator housing 230 behind the wall covering assembly 62 for dissemination of the cooled air into the refrigerator compartment 12 via the ports 172A disposed on the ventilated portion 170 of the wall covering assembly 62. Thus, the first fan 206, as shown in FIG. 5, is fluidly coupled to the duct assembly 70. Further, a second fan 210 is disposed within the ice maker feed duct 120 and is therefore fluidly coupled to the evaporator housing 230. The second fan 210 is configured to draw cooled air provided by the refrigerator evaporator 160 into the ice maker feed duct 120 of the duct assembly 70 for moving super cooled air in an upward direction as indicated by arrow 140. In this way, cooled air is not only provided to the refrigerator compartment 12 by the ventilated portion 170 of the wall covering assembly 62 through the refrigerator evaporator 160 using the first fan 206, but cooled air from the refrigerator evaporator 160 is also provided to the ice maker 30 (FIG. 3) via the ice maker feed duct 120 using the second fan 210. Thus, the first fan 206 and the second fan 210 are both in thermal communication with the refrigerator evaporator 160 and are fluidly connected to the duct assembly 70 within the housing area 202. As shown in FIG. 5, the evaporator 160, the first fan 206 and the second fan 210 are substantially concealed by the wall covering assembly 62 within the refrigerator compartment 12 in assembly. In FIG. 5, it is contemplated that the first door 18 (FIG. 1) is in a closed position, such that the ice maker feed duct 120 and the ice maker return duct 122 can couple to the ice maker 30.

In use, it is contemplated that the refrigerator evaporator 160 will provide cooled air at a first temperature level for a refrigerator compartment cooling cycle, in which the first fan 206 draws the cooled air from the refrigerator evaporator 160 into the refrigerator compartment 12 via the duct assembly 70. It is further contemplated that the refrigerator evaporator 160 will provide cooled air at a second temperature level, that is cooler than the first temperature level, during an ice making cycle, wherein cooled air at the second temperature level is provided to the ice maker 30 via the ice maker feed duct 120 using the second fan 210. Thus, a controller for the refrigerator 10 is contemplated for use with the present concept which controls the refrigerator evaporator 160 as well as the first and second fans 206, 210. Specifically, the controller may be positioned in any location on the refrigerator 10, such as a machine compartment, and can dictate which temperature level the refrigerator evaporator 160 will provide cooled air at, and which fan will be used to draw or propel air through the duct assembly 70. By controlling the first and second fans 206, 210 for use separately during different cooling cycles, the controller of the refrigerator 10 of the present concept provides for a refrigerator evaporator 160 that can provide cooled air to both the refrigerator compartment 12 and the ice maker 30 at separate and distinct cycle times so as not to introduce super cooled air intended for the ice maker 30 into the refrigerator compartment 12, and vice versa.

Referring now to FIG. 6A, the refrigerator 10 is shown with the exterior wrapper 32 disposed around the refrigerator liner 42 to create a vacuum insulated space 220 therebetween. As specifically shown in FIG. 6A, the refrigerator liner 42 includes a rear wall 50 that is adjacent to and spaced-apart from the rear wall 64 of the wall covering assembly 62. Thus, as shown in FIG. 6A, a cavity 222 is formed between the spaced-apart portions of the refrigerator liner 42 and the wall covering assembly 62. The cavity 222 includes a first portion 224 that extends between the rear wall 64 of the wall covering assembly 62 and the rear wall 50 of the refrigerator liner 42. As shown in FIG. 6A, the first portion 224 of the cavity 222 houses the vertical sections of the duct assembly 70, which is includes as upright ducts 76, 78 and the first portion 120A of ice maker feed duct 120 and the first portion 122A of the ice maker return duct 122.

Referring now to FIG. 6B, the top wall 48 of the refrigerator liner 42 is disposed adjacent to and spaced-apart from the top wall 66 of the wall covering assembly 62. Thus, the cavity 222 further includes a second portion 226 that extends outwardly in a substantially horizontal manner relative to the first portion 224 (FIG. 6A) of the cavity 222. The second portion 226 of the cavity 222 is configured to house the upper ducts 90, 92, as well as the second portion 120B of ice maker feed duct 120 and the second portion 122B of the ice maker return duct 122 of the duct assembly 70. As shown in FIGS. 6A and 6B, the wall covering assembly 62 is disposed within the refrigerator compartment 12 defined by the refrigerator liner 42. As such, the duct assembly 70 and refrigerator evaporator 160, and any other components housed in the cavity 222, are also housed in the refrigerator compartment 12.

Referring now to FIG. 7, the duct assembly 70 is shown disposed on the wall covering assembly 62 with the ice maker feed duct 120 having another embodiment of a second fan 210A, wherein the second fan 210A is disposed within the ice maker feed duct 120 between the first portion 120A and the second portion 120B of the ice maker feed duct 120. Thus, with the second fan 210 disposed on an upper portion of the duct assembly 70, during an ice making cycle, the refrigerator evaporator 160 will provide cooled air (contemplated to be below freezing) which will be drawn in the path as indicated by arrow 140 upwards towards the second fan 210A along the first portion 120A of the ice maker feed duct 120 when the second fan 210A is activated. Further, the second fan 210A, given its position in the embodiment shown in FIG. 7, will propel air along the path as indicated by arrow 142 along the second portion 120B of the ice maker feed duct 120 to provide the cooled air to the ice maker 30 during an ice making cycle. As shown in FIG. 7, the ice maker feed duct 120 is operably coupled to the evaporator housing 230 at a first end 120C thereof. The ice maker feed duct 120 is further coupled to the ice maker 30 at a second end 120D thereof. In this way, the ice maker feed duct 120 fluidically interconnects the refrigerator evaporator 160 and the evaporator housing 230 with the ice maker 30 by providing a direct airway therebetween. As further shown in the embodiment of FIG. 7, the ice maker return duct 122 is shown as being operably coupled to an evaporator housing 230 at a first end 122C of the ice maker return duct 122 for dispensing cooled air returned from the ice maker 30 to a lower portion 232 of the evaporator housing 230. The ice maker return duct 122 is further coupled to the ice maker 30 at a second end 122D thereof. In this way, the ice maker return duct 122 fluidically interconnects the refrigerator evaporator 160 and the evaporator housing 230 with the ice maker 30 by providing a direct airway therebetween.

The evaporator housing 230 is configured to house the refrigerator evaporator 160 and is operably coupled to, and in fluid communication with, the fan housing 204 in which the first fan 206 is disposed. Specifically, the fan housing 204 is considered an upper part of the evaporator housing 230. In FIG. 7, the upright ducts 76, 78 and the upper ducts 90, 92 are shown interconnecting the refrigerator compartment 12 with the evaporator housing 230 to define one or more ducts of the duct assembly 70 configured to supply cooled air to the refrigerator compartment 12. As further shown in FIG. 7, the upright ducts 76, 78 and the upper ducts 90, 92 are separate and distinct from the ice maker feed duct 120 and the ice maker return duct 122, such that the refrigerator 10 can cool the refrigerator compartment 12 and the ice maker 30 at separate times using separate cooling cycles, as further described below.

Referring now to FIG. 8, another embodiment of the present concept is shown, wherein the fan housing 204 is disposed below the refrigerator evaporator 160 and includes another embodiment of a first fan 206A. In this embodiment, it is contemplated that the first fan 206A will be used to push air over the refrigerator evaporator 160 into the first and second upright ducts 76, 78 for cooling the refrigerator compartment 12.

It is contemplated that a controller for the refrigerator 10 is provided that controls both the first fan 206 and 206A and the second fan 210 and 210A, such that they can run at distinct times during distinct cooling cycles (i.e. the refrigerator compartment cooling cycle, and the ice making cycle). Therefore, in the embodiments shown in FIGS. 5, 7 and 8, it is contemplated that the first fan 206 or 206A will run during a refrigerator compartment cooling cycle with temperatures provided at a first temperature level via the refrigerator evaporator 160. It is contemplated that the second fan 210 or 210A will not run during this refrigerator compartment cooling cycle so as not to draw air intended for the refrigerator compartment 12 into the ice maker 30. Further, in the embodiment shown in FIGS. 5, 7 and 8, it is contemplated that the second fan 210 or 210A will run during an ice making cycle with temperatures provided at a second temperature level via the refrigerator evaporator 160, wherein the second temperature level is less than the first temperature level. The second temperature level is contemplated to be a temperature level below freezing to provide for appropriate temperatures for making ice in the ice maker 30. It is contemplated that the first fan 206 or 206A will not run during this ice making cycle so as not to draw air intended for the ice maker 30 into the refrigerator compartment 12 during the ice making cycle.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A refrigerator, comprising:

a cabinet structure having a refrigerator compartment;

an evaporator positioned in the refrigerator compartment within an evaporator housing;

a door pivotally coupled to the cabinet structure for selectively providing access to the refrigerator compartment, wherein the door includes an ice maker operably coupled to the door for pivoting movement therewith;

a duct assembly disposed within the refrigerator compartment and having an ice maker feed duct operably coupled to the evaporator housing at a first end and further coupled to the ice maker at a second end, wherein the duct assembly further includes an ice maker return duct operably coupled to the evaporator housing at a first end and further coupled to the ice maker at a second end;

a liner disposed within the refrigerator compartment, the liner including a top wall, first and second sidewalls, a bottom wall and a rear wall;

a wall covering assembly having a top wall disposed adjacent to and spaced-apart from the top wall of the liner, wherein the wall covering assembly further includes a rear wall disposed adjacent to and spaced-apart from the rear wall of the liner; and a cavity formed between liner and the wall covering assembly, the cavity including a first portion disposed between the rear wall of the liner and the rear wall of the wall covering assembly, and a second portion disposed between the top wall of the liner and the top wall of the wall covering assembly.

2. The refrigerator of claim 1, wherein the ice maker feed duct includes a first portion disposed in the first portion of the cavity, and further wherein the ice maker feed duct includes a second portion disposed in the second portion of the cavity.

3. The refrigerator of claim 2, wherein the ice maker return duct includes a first portion disposed in the first portion of the cavity, and further wherein the ice maker return duct includes a second portion disposed in the second portion of the cavity.

4. The refrigerator of claim 1, wherein the duct assembly includes one or more ducts interconnecting the evaporator housing with the refrigerator compartment, wherein the one or more ducts are separate from the ice maker feed duct and the ice maker return duct.

5. The refrigerator of claim 4, including:

a first fan disposed within the evaporator housing, wherein the first fan is fluidly connected to the one or more ducts of the duct assembly, the first fan configured to move cooled air from the evaporator to the refrigerator compartment via the one or more ducts of the duct assembly.

6. The refrigerator of claim 5, including:

a second fan disposed within the ice maker feed duct, wherein the second fan is fluidly connected to the evaporator housing via the first end of the ice maker feed duct, the second fan configured to move cooled air from the evaporator to the ice maker via the ice maker feed duct of the duct assembly.

7. The refrigerator of claim 1, wherein the ice maker feed duct and the ice maker return duct are insulated ducts.

8. A refrigerator, comprising:

a liner defining a refrigerator compartment and having a top wall and a rear wall;

a refrigerator evaporator disposed within an evaporator housing within the refrigerator compartment;

a wall covering assembly having a top wall and a rear wall, wherein the wall covering assembly is spaced-apart from the liner to form a cavity therebetween;

an ice maker; and a duct assembly disposed within the cavity and having an ice maker feed duct interconnecting the evaporator housing with the ice maker, wherein the duct assembly further includes an ice maker return duct interconnecting the evaporator housing with the ice maker.

9. The refrigerator of claim 8, wherein the duct assembly includes one or more ducts interconnecting the evaporator housing with the refrigerator compartment, wherein the one or more ducts are separate from the ice maker feed duct and the ice maker return duct.

10. The refrigerator of claim 9, including:

a first fan disposed within the evaporator housing, wherein the first fan is fluidly connected to the one or more ducts of the duct assembly and configured to move cooled air from the refrigerator evaporator to the refrigerator compartment through the one or more ducts of the duct assembly.

11. The refrigerator of claim 10, including:

a second fan disposed within the ice maker feed duct and configured to move cooled air from the refrigerator evaporator to the ice maker through the ice maker feed duct of the duct assembly.

12. The refrigerator of claim 11, including:

a controller for controlling the refrigerator evaporator to provide a refrigerator compartment cooling cycle and an ice making cycle.

13. The refrigerator of claim 12, wherein the refrigerator evaporator provides cooled air at a first temperature level during the refrigerator compartment cooling cycle, and further wherein the refrigerator evaporator provides cooled air at a second temperature level that is lower than the first temperature level during the ice making cycle.

14. The refrigerator of claim 13, wherein the first fan is configured to run during the refrigerator compartment cooling cycle.

15. The refrigerator of claim 13, wherein the second fan is configured to run during the ice making cycle.

16. A refrigerator, comprising:

a refrigerator compartment defined by a liner, wherein the liner includes a top wall, a rear wall, first and second sidewalls and a bottom wall;

a door operably coupled to the refrigerator compartment between open and closed positions, wherein the door includes an ice maker;

a wall covering assembly having a top wall disposed adjacent to and spaced-apart from the top wall of the liner and a rear wall disposed adjacent to and spaced-apart from the rear wall of the liner, wherein the liner and the wall covering assembly cooperate to define a cavity therebetween;

a refrigerator evaporator disposed within the cavity; and a duct assembly disposed within the cavity and fluidically coupled to the refrigerator evaporator, the duct assembly including an ice maker feed duct operably coupled to the ice maker when the door is in the closed position, wherein the duct assembly further includes an ice maker return duct operably coupled to the ice maker when the door is in the closed position.

17. The refrigerator of claim 16, wherein the refrigerator includes a refrigerator compartment cooling cycle and a separate ice making cycle.

18. The refrigerator of claim 17, wherein the refrigerator evaporator provides cooled air at a first temperature level to the refrigerator compartment through the duct assembly during the refrigerator compartment cooling cycle.

19. The refrigerator of claim 18, wherein the refrigerator evaporator provides cooled air at a second temperature level that is lower than the first temperature level to the ice maker through the ice maker feed duct during the ice making cycle.

* * * * *